US010173431B2

(12) United States Patent
Kawate et al.

(10) Patent No.: US 10,173,431 B2
(45) Date of Patent: Jan. 8, 2019

(54) LIQUID CONTAINING MEMBER

(71) Applicant: SEIKO EPSON CORPORATION, Tokyo (JP)

(72) Inventors: Hiroyuki Kawate, Hokuto (JP); Manabu Yamaguchi, Shiojiri (JP); Tadahiro Mizutani, Shiojiri (JP); Takuma Ozawa, Shiojiri (JP); Satoshi Oya, Matsumoto (JP); Hiroyoshi Ozeki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/982,736

(22) Filed: May 17, 2018

(65) Prior Publication Data

US 2018/0264829 A1 Sep. 20, 2018

Related U.S. Application Data

(63) Continuation of application No. 15/383,279, filed on Dec. 19, 2016, now Pat. No. 10,000,063.

(30) Foreign Application Priority Data

Dec. 21, 2015 (JP) ..... 2015-248585

(51) Int. Cl.
*B41J 2/175* (2006.01)
*B41J 2/14* (2006.01)

(52) U.S. Cl.
CPC ..... *B41J 2/17506* (2013.01); *B41J 2/17513* (2013.01); *B41J 2/1404* (2013.01); *B41J 2/14072* (2013.01); *B41J 2/14112* (2013.01); *B41J 2/14129* (2013.01); *B41J 2/14145* (2013.01); *B41J 2002/17516* (2013.01)

(58) Field of Classification Search
CPC ..... B41J 2/17506; B41J 2/17513; B41J 2/14145; B41J 2/14129; B41J 2/14112; B41J 2/1404; B41J 2002/17516; B41J 2/14072
See application file for complete search history.

(56) References Cited

U.S. PATENT DOCUMENTS

2010/0231620 A1* 9/2010 Shinada ..... B41J 2/175 347/6

FOREIGN PATENT DOCUMENTS

| | | | |
|---|---|---|---|
| JP | 2008-087486 | A | 4/2008 |
| JP | 4410023 | B | 11/2009 |
| JP | 2013-111845 | A | 6/2013 |

* cited by examiner

*Primary Examiner* — Lisa M Solomon
(74) *Attorney, Agent, or Firm* — Foley & Lardner LLP

(57) ABSTRACT

A liquid containing member that can supply a liquid having a uniform concentration of a precipitating component to a liquid ejecting portion is provided. A liquid containing member includes: a liquid containing portion that can contain ink; a liquid supply port for supplying the ink contained in the liquid containing portion to a liquid ejection head; and a communication channel that is in communication with the liquid containing portion and the liquid supply port. The communication channel has a first end that is positioned at a lower end on the gravity direction side in the liquid containing portion and can suck the ink, and a second end that is positioned closer to the anti-gravity direction side than the first end is, and can suck the ink, in an in-use state in which the ink is supplied from the liquid supply port to the liquid ejection head.

9 Claims, 8 Drawing Sheets

LIQUID CONTAINING MEMBER

This application is a continuation of U.S. application Ser. No. 15/383,279 filed on Dec. 19, 2016, which claims priority to Japanese Application No. 2015-248585 filed on Dec. 21, 2015; the entire disclosures of both of which are expressly incorporated by reference herein.

BACKGROUND

1. Technical Field

The present invention relates to a liquid containing member that can contain a liquid having a precipitating component.

2. Related Art

Inkjet printers have been known as an example of a liquid consuming apparatus that consumes a liquid (e.g., ink) having a precipitating component (e.g., pigment) by ejecting it from a liquid ejecting portion that can eject a liquid. In such printers, a liquid containing member (e.g., ink cartridge) including a liquid containing portion (e.g., ink pack (liquid bag)) that can contain a liquid is contained inside a printer casing, and a liquid is supplied from the liquid containing member contained inside the casing to the liquid ejecting portion.

This liquid containing member is provided with a liquid supply port through which a liquid contained in the liquid containing portion is supplied to the liquid ejecting portion. The liquid supplied from the liquid supply port to the liquid ejecting portion has to be controlled such that a change in the concentration of the precipitating component is suppressed. The reason for this is that, if the concentration of the precipitating component in the liquid supplied from the liquid supply port is non-uniform, a liquid having a uniform concentration may not be ejected from the liquid ejecting portion. In this case, for example, when ejecting the liquid from the liquid ejecting portion onto paper and printing an image or the like thereon, the density of the printed image changes, resulting in a deterioration in the printing quality.

Thus, in a liquid containing member in a related art, a liquid supply port (liquid discharge portion) is disposed at the center in the vertical direction of a liquid containing portion (ink pack), and liquid sucking portions (liquid sucking channels) that can suck a liquid (ink) are provided respectively at an upper portion on the anti-gravity direction side and a lower portion on the gravity direction side of the liquid supply port. If a liquid having a high concentration of the precipitating component and a liquid having a low concentration of the precipitating component are respectively sucked by the provided liquid sucking portions and mixed thereby, a liquid (ink) having a uniform concentration of the precipitating component is discharged from the liquid containing member (see JP-A-2008-87486, for example).

However, according to the liquid containing member in the related art, both the two liquid sucking portions provided at the upper and lower portions are positioned at the center in the vertical direction of the liquid containing portion, and thus, in the liquid containing portion, a liquid in the vicinity of the center near the liquid sucking portions is easily sucked out, whereas a liquid at the lower end on the gravity direction side or at the upper end on the anti-gravity direction side, far from the liquid sucking portions, is not easily sucked out. Accordingly, liquids having different concentrations tend to remain in the liquid containing portion, causing a problem that it becomes harder to supply (discharge) a liquid having a uniform concentration from the liquid containing member in accordance with the progress of the consumption of liquid.

Note that such a situation is substantially shared by liquid containing members, including a liquid containing portion that can contain a liquid having a precipitating component, and a liquid supply port for supplying the liquid contained in the liquid containing portion to a liquid ejecting portion.

SUMMARY

An advantage of some aspects of the invention is to provide a liquid containing member that can supply a liquid having a uniform concentration of a precipitating component to a liquid ejecting portion.

Hereinafter, means for solving the above-described problem and advantageous effects thereof will be described.

A liquid containing member that solves the above-described problem is a liquid containing member capable of supplying a liquid having a precipitating component to a liquid ejecting portion. The liquid containing member includes: a liquid containing portion configured to contain the liquid; a liquid supply port configured to supplying the liquid contained in the liquid containing portion to the liquid ejecting portion; and a communication channel communicating with the liquid containing portion and the liquid supply port. The communication channel has a first liquid sucking portion positioned at a lower end on the gravity direction side in the liquid containing portion and configured to suck the liquid, in an in-use state in which the liquid is supplied from the liquid supply port to the liquid ejecting portion. The communication channel also has a second liquid sucking portion positioned at the anti-gravity direction side relative to the first liquid sucking portion, and configured to suck the liquid, in the in-use state.

With this configuration, a liquid having a comparatively high concentration of the precipitating component is sucked from the first liquid sucking portion, and a liquid having a comparatively low concentration of the precipitating component is sucked from the second liquid sucking portion, and these liquids are then mixed and caused to flow through the liquid supply port. Thus, a liquid having a uniform concentration of the precipitating component can be supplied to the liquid ejecting portion. Accordingly, for example, in the case of printing an image on paper using a liquid ejected from the liquid ejecting portion, a liquid having a uniform concentration of the precipitating component is ejected, and thus a deterioration in the printing quality can be suppressed.

Preferably, the liquid containing member is such that, in the in-use state, the second liquid sucking portion is positioned at an upper end on the anti-gravity direction side in the liquid containing portion.

With this configuration, liquids can be sucked from both the upper end and the lower end in the liquid containing portion and mixed to be supplied to the liquid ejecting portion, and thus, even when the consumption of liquid progresses, a liquid having a uniform concentration can be easily supplied to the liquid ejecting portion.

Preferably, the liquid containing member is such that the communication channel has a first channel and a second channel, and the first liquid sucking portion is a first end that is in communication with the liquid containing portion in the first channel, and the second liquid sucking portion is a second end that is in communication with the liquid containing portion in the second channel.

With this configuration, the liquid sucking portions are respectively an end of the first channel and an end of the second channel, and thus the liquid sucking portions can be easily positioned in the liquid containing portion.

Preferably, the liquid containing member further includes a positioning unit that positions the first end of the first channel and the second end of the second channel in the liquid containing portion.

With this configuration, the first end and the second end are positioned and held in the liquid containing portion, and thus positional shift of the liquid sucking portions in the liquid containing portion is suppressed.

Preferably, the liquid containing member is such that the positioning unit is a biasing member that is connected between the first end and the second end, and that biases the first end toward the gravity direction side and biases the second end toward the anti-gravity direction side.

With this configuration, with a positioning unit having a simple structure, the first end and the second end can be positioned in the liquid containing portion.

Preferably, the liquid containing member is such that the positioning unit is channel portions made of materials respectively having different specific gravities with respect to the liquid, in the first channel and the second channel.

With this configuration, with a simple structure, the first end and the second end can be positioned in the liquid containing portion.

Preferably, the liquid containing member is such that the positioning unit is a weight member that is attached to the first channel and a float member that is attached to the second channel.

With this configuration, with a simple structure, the first end and the second end can be positioned in the liquid containing portion. Preferably, the liquid containing member is such that the liquid containing portion is at least partially made of a film sheet, and the positioning unit includes a block member that is attached to the first end and the second end and is fixed to the film sheet.

With this configuration, with a simple structure, the first end and the second end can be precisely positioned in the liquid containing portion. Preferably, the liquid containing member is such that the positioning unit includes a frame member that supports the first channel and the second channel in the liquid containing portion.

With this configuration, with a simple structure, the first end and the second end can be precisely positioned in the liquid containing portion.

Preferably, the liquid containing member is such that the frame member is partially fixed to a member constituting the liquid containing portion.

With this configuration, the first end and the second end are prevented from rotating in the liquid containing portion, so that the first end and the second end can be reliably positioned in the liquid containing portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid consuming apparatus will be described with reference to the drawings. The liquid consuming apparatus of this embodiment is an apparatus (e.g., printer) that records (prints) an image or the like on a medium by discharging ink, which is an example of a liquid, onto the medium.

Figure 1:
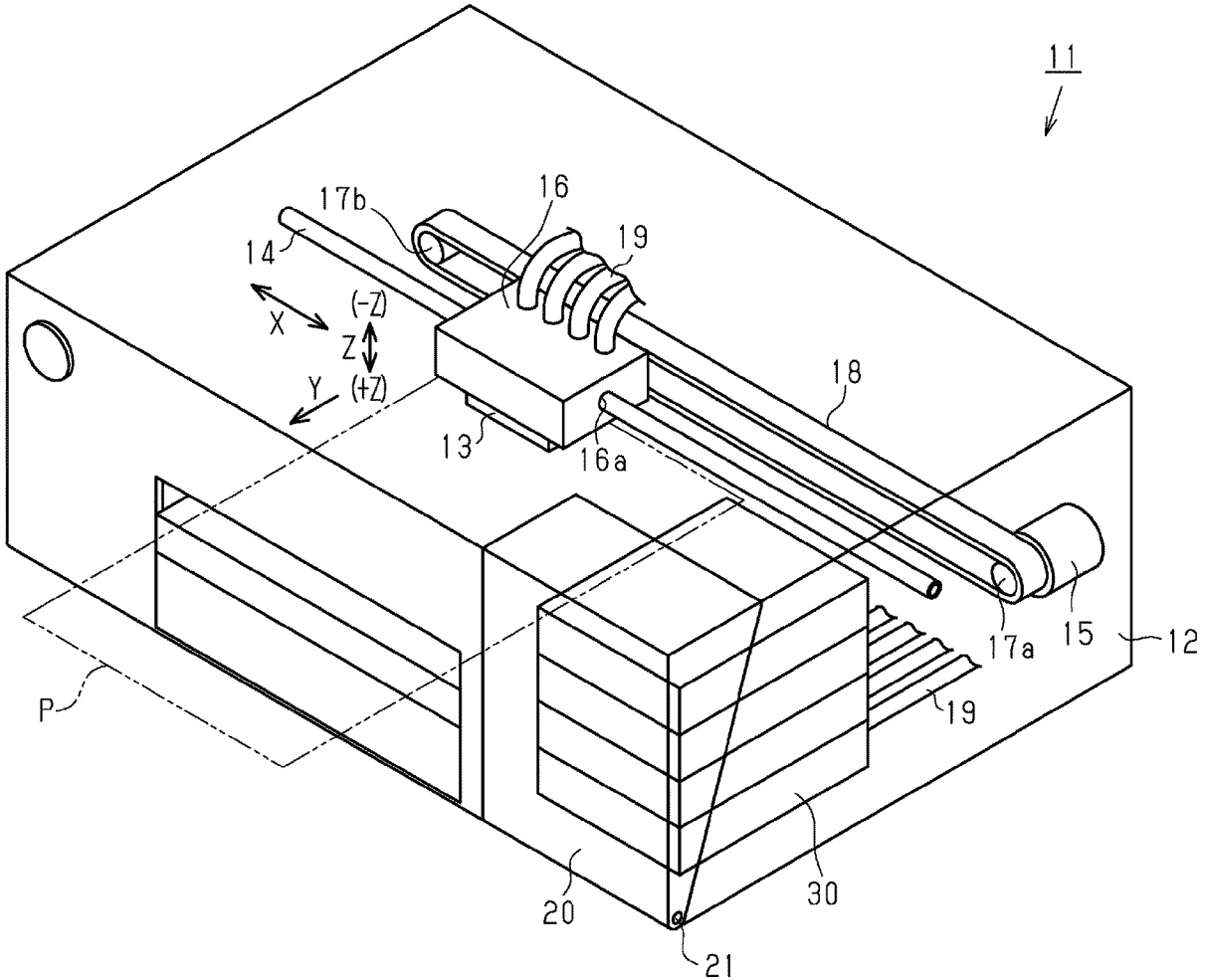
FIG. 1 shows a perspective view schematically showing, in a see-through state, the schematic configuration of an embodiment of a liquid consuming apparatus.

As shown in FIG. 1, a liquid consuming apparatus 11 of this embodiment includes a liquid ejection head 13, which is an example of a liquid ejecting portion that ejects ink onto paper P, which is an example of a medium that is being conveyed in one direction, liquid containing members 30 that can internally contain ink that is to be ejected by the liquid ejection head 13, and a casing 12 substantially in the shape of a rectangular parallelepiped that can internally contain the liquid containing members 30. In FIG. 1, the liquid consuming apparatus 11 is shown in a state where the internal portion is seen through the casing 12.

The liquid ejection head 13 is included in a carriage 16 that is supported on a guide shaft 14 provided inside the casing 12 and having an axis extending in one direction, and that is driven by a carriage motor 15 to move back and forth in the axial direction of the guide shaft 14 inside the casing 12 of the liquid consuming apparatus 11.

Specifically, the guide shaft 14 is fixed at both ends thereof inside the casing 12, and is inserted through a through hole 16*a* that is formed through the carriage 16. In the casing 12, a driving pulley 17*a* and a driven pulley 17*b* are rotatably supported respectively near both ends of the guide shaft 14. An output shaft of the carriage motor 15 is linked to the driving pulley 17*a*, and an endless timing belt 18, part of which is linked to the carriage 16, is wound around the driving pulley 17*a* and the driven pulley 17*b*. If the carriage motor 15 is driven, the carriage 16 is guided via the timing belt 18 by the guide shaft 14 to move back and forth along the axial direction thereof, that is, along a scanning direction X.

The liquid ejection head 13 is disposed on a gravity direction (+Z) side (also referred to as the lower side) in a vertical direction Z of the carriage 16. The ink that is to be supplied to the liquid ejection head 13 is positioned closer to an anti-gravity direction (−Z) side (also referred to as the upper side) than the paper P is, the paper P being conveyed in a conveyance direction Y that intersects the scanning direction X, and is ejected from the liquid ejection head 13 that moves together with the carriage 16 along the scanning direction X that matches the width direction of the paper P, so that an image or the like is recorded (printed) on the paper P.

The liquid containing members 30 containing ink that is to be supplied to the liquid ejection head 13 can be contained inside the casing 12. In this embodiment, the liquid containing members 30 are contained inside the casing 12, at a corner of the casing 12 (corner in the horizontal direction), which is on the conveyance direction Y side toward which the paper P is conveyed during recording of an image or the like and one end side in the scanning direction X. Liquid supply tubes 19 through which ink can flow are linked between the liquid containing members 30 and the carriage 16. The ink contained in the liquid containing members 30 is supplied via the linked liquid supply tubes 19 to the liquid ejection head 13.

In this embodiment, four liquid containing members 30 are substantially in the shape of rectangular parallelepipeds, and are contained inside the casing 12 in a stacked state in which the sides in the thickness directions of the liquid containing members 30 are arranged on top of another along the vertical direction Z. The liquid containing members 30 contain ink having pigments, each of which is an example of a precipitating component (e.g., pigment ink having different colors, that is, the colors cyan, magenta, yellow, and black).

In this embodiment, in the casing 12, a casing portion that faces the liquid containing members 30, on the front side of the casing 12 positioned on the conveyance direction Y side toward which the paper P is conveyed, is provided as a cover member 20 that can rotate about a rotational shaft 21 provided on the lower side. If the cover member 20 is rotated (swung) about the rotational shaft 21, the liquid containing members 30 are exposed, and a user can attach/detach or replace the liquid containing members 30 in a state where the liquid containing members 30 are exposed.

Figure 2:
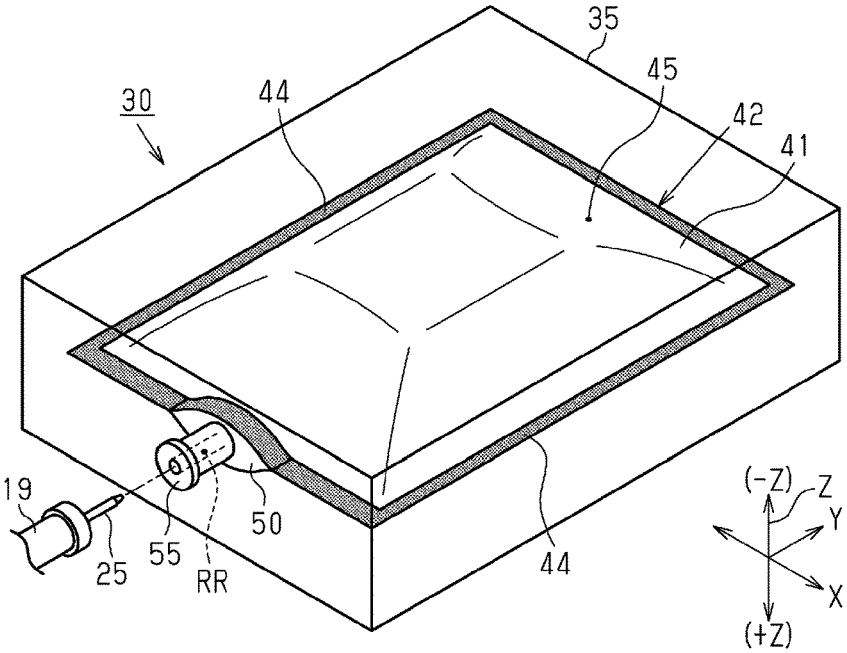
FIG. 2 shows a perspective view showing, in a see-through state, a liquid containing member having a liquid containing portion containing a liquid that is to be supplied to a liquid ejecting portion.

As shown in FIG. 2, the liquid containing members 30 have the same configuration, and each include a liquid containing portion 45 that can contain ink and a container casing 35 that internally contains the liquid containing portion 45. The liquid containing portion 45 is configured by a liquid bag 42 substantially in the shape of a rectangle constituted by two film sheets 41 (see FIG. 4) whose outer periphery is sealed as indicated by the shaded region in FIG. 2, and a joint member 50 that is inserted between the two film sheets 41 at one portion (one side) of the sealed outer periphery, wherein the two film sheets 41 are joined to both sides of the joint member 50.

Specifically, the liquid bag 42 is first formed in the shape of a bag by sealing flexible two film sheets 41 made of a resin material such that three of the four outer peripheral sides are adhered. Next, in a state where the joint member 50 made of a resin material is inserted into an opening side of the liquid bag 42 constituted by one side that has not been sealed, that one side is adhered together with the joint member 50, so that a sealed portion 44 is formed at the outer periphery of the liquid bag 42 as indicated by the shaded region in FIG. 2, and the inside of the liquid bag 42 can be used as the liquid containing portion 45. That is to say, the liquid containing portion 45 is an internal space defined by the liquid bag 42 and the joint member 50. In other words, the liquid containing portion 45 is a so-called ink bag constituted by the liquid bag 42 at least partially made of flexible film sheets 41, and the joint member 50. In accordance with a decrease in the volume of the liquid containing portion 45 due to flowing out of the ink, the flexible liquid bag 42 is deformed such that the gap between the two film sheets 41 facing each other is narrowed (the liquid bag 42 is flattened).

The joint member 50 is provided with a liquid supply port 55 for supplying the ink contained in the liquid containing portion 45, that is, inside the liquid bag 42, to the liquid ejection head 13, in an exposed state where the liquid supply port 55 can be seen from the outside of the container casing 35. Note that, in this example, the liquid supply port 55 projects to the outside of the container casing 35 (see FIG. 3). Meanwhile, inside the casing 12, supply needles 25 are provided on the front side in the direction in which the liquid containing members 30 are inserted. Thus, when each liquid containing member 30 is attached to the casing 12, the corresponding supply needle 25 is inserted into the liquid supply port 55, so that ink flows out (is discharged) from the liquid supply port 55 to the supply needle 25. The ink that has flowed out to the supply needle 25 is supplied via the liquid supply tube 19 to the liquid ejection head 13, by the action of an unshown pump (e.g., diaphragm pump) provided in the casing 12.

In the liquid containing member 30 of this embodiment, a communication channel RR that is in communication with the liquid containing portion 45 and the liquid supply port 55 is provided in order to supply ink from the liquid containing portion 45 to the liquid ejection head 13. Furthermore, the communication channel RR includes liquid sucking portions that can suck ink contained in the liquid containing portion 45. Hereinafter, the communication channel RR and the liquid sucking portions will be described with reference to the drawings.

Figure 3:
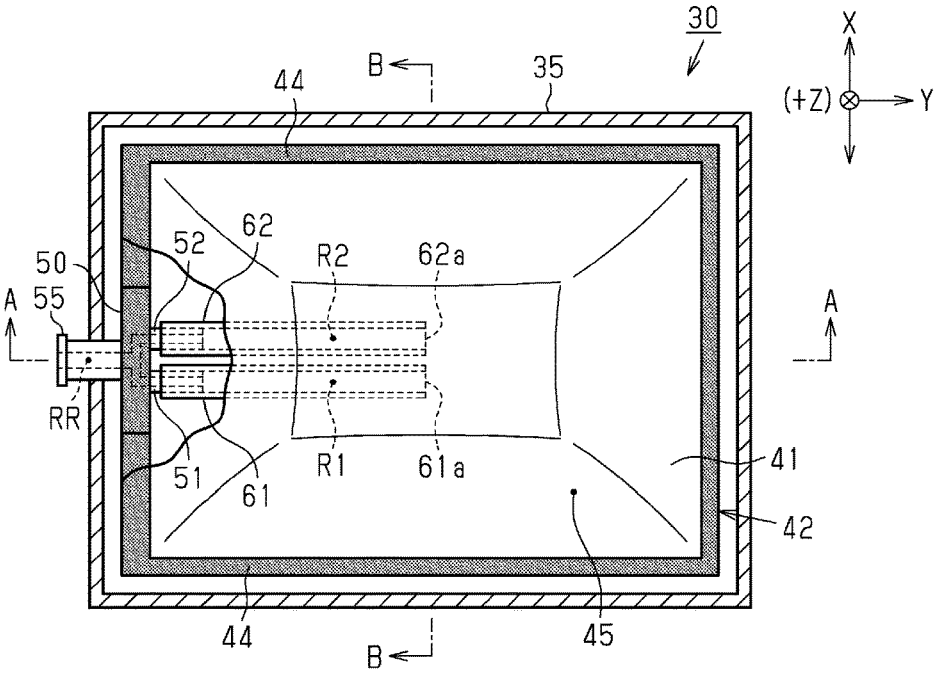
FIG. 3 shows a horizontal cross-sectional view showing the configuration of the liquid containing member in a state where part of the members is cut away.
Figure 4:
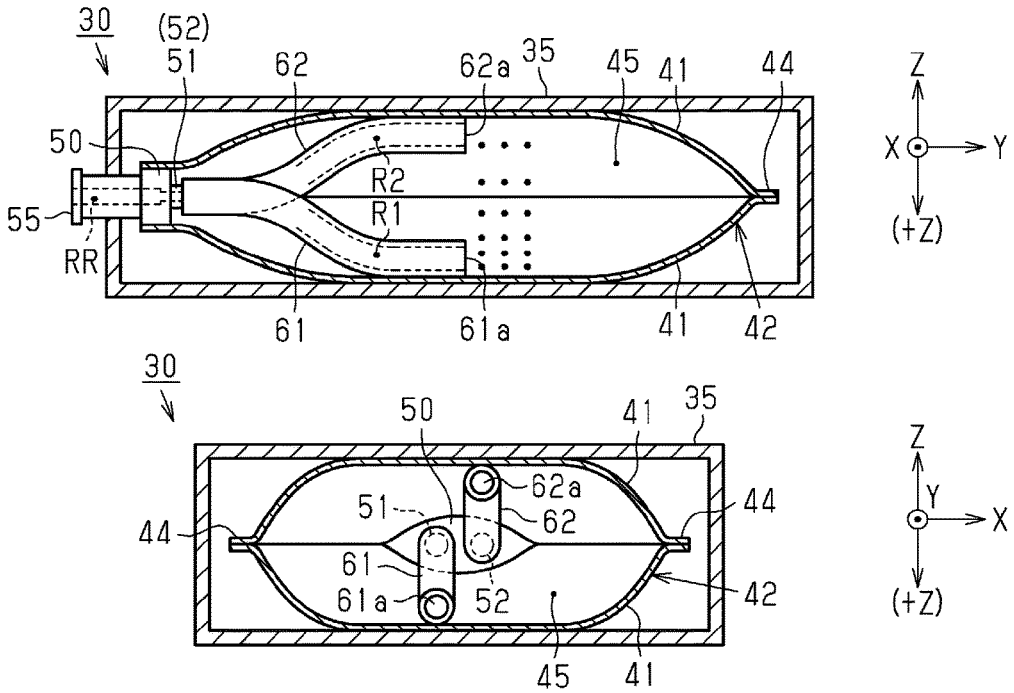
FIG. 4 shows cross-sectional views showing the configuration of the liquid containing member, wherein the upper portion is a cross-sectional view seen in the direction of arrows A-A in FIG. 3, and the lower portion is a cross-sectional view seen in the direction of arrows B-B in FIG. 3.

As shown in FIGS. 3 and 4, in the joint member 50 where the liquid supply port 55 is formed, a first communication port 51 and a second communication port 52, both of which are in communication with the liquid supply port 55 in the joint member 50, are provided inside the liquid bag 42. In this embodiment, the first communication port 51 and the second communication port 52 are arranged side by side substantially in the horizontal direction along the scanning direction X, in a state where the liquid containing member 30 is attached to the casing 12. For the sake of ease of description, FIG. 3 shows a state in which part of the film sheets 41 is cut away, and FIG. 4 shows cross-sections of the container casing 35 and the liquid bag 42 taken along lines indicated by arrows A-A and B-B in FIG. 3.

A first tube 61 having a predetermined length with both ends cut is attached to the first communication port 51 by pushing one of the cut tube ends into the first communication port 51, while a first end 61*a*, which is the other cut tube end, is positioned substantially at the center in the conveyance direction Y in the liquid containing portion 45. Furthermore, a second tube 62 having a predetermined length with both ends cut is attached to the second communication port 52 by pushing one of the cut tube ends into the second communication port 52, while a second end 62*a*, which is the other cut tube end, is positioned substantially at the center in the conveyance direction Y in the liquid containing portion 45.

Accordingly, in the liquid containing member 30, a first channel R1 is constituted by the first tube 61 and the joint member 50 in which ink in the liquid containing portion 45 flows from the first tube 61 via the first communication port 51 to the liquid supply port 55. Furthermore, in the liquid containing member 30, a second channel R2 is constituted by the second tube 62 and the joint member 50 in which ink in the liquid containing portion 45 flows from the second tube 62 via the second communication port 52 to the liquid supply port 55. That is to say, the first channel R1 and the second channel R2 constitute the communication channel RR that is in communication with the liquid containing portion 45 and the liquid supply port 55.

In this embodiment, in an in-use state of the communication channel RR in which ink is supplied from the liquid supply port 55 to the liquid ejection head 13, the first end 61*a* of the first tube 61, which is an end of the first channel R1, is positioned at the lower end on the gravity direction (+Z) side in the liquid containing portion 45. Furthermore, the second end 62*a* of the second tube 62, which is an end of the second channel R2, is positioned at the upper end on the anti-gravity direction (−Z) side in the liquid containing portion 45. That is to say, in this embodiment, the first tube 61 is formed in a curved shape such that the first end 61*a* is positioned at the lower end on the gravity direction (+Z) side in the liquid containing portion 45, and the second tube 62 is formed in a curved shape such that the second end 62*a* is positioned at the upper end on the anti-gravity direction (−Z) side in the liquid containing portion 45.

Accordingly, in an in-use state in which ink is supplied from the liquid supply port 55 of the liquid containing member 30 attached to the inside of the casing 12 to the liquid ejection head 13, the first end 61*a* is positioned at the lower end on the gravity direction (+Z) side in the liquid containing portion 45 and functions as a first liquid sucking portion that can suck ink in the liquid containing portion 45. Furthermore, the second end 62*a* is positioned closer to the anti-gravity direction (−Z) side than the first end 61*a* is, the first end 61*a* functioning as the first liquid sucking portion. The second end 62*a* functions as a second liquid sucking portion that can suck ink in the liquid containing portion 45.

The joint member 50 constituting the communication channel RR is included in the liquid containing member 30 so as to be positioned between the first end 61*a* of the first tube 61 and the second end 62*a* of the second tube 62 in the vertical direction Z. Incidentally, in this embodiment, in a state where ink contained in the liquid containing portion 45 has not been consumed, the joint member 50 is included in the liquid containing member 30 such that the first communication port 51 and the second communication port 52 formed in the joint member 50 are positioned at the middle between the first end 61*a* and the second end 62*a* in the vertical direction Z.

Hereinafter, an action of each liquid containing member 30 of this embodiment will be described.

Ink contained in the liquid containing portion 45 has a concentration distribution in which the pigment concentration is lowest on the upper end side and is highest on the lower end side in the liquid containing portion 45 as indicated by the black dots in part of the liquid containing portion 45 in FIG. 4, because pigment is precipitated toward the gravity direction (+Z) side under its own weight.

According to the liquid containing member 30 of this embodiment, in the liquid containing portion 45, ink having a high pigment concentration is sucked from the first end 61*a* (first liquid sucking portion) positioned at the lower end, and ink having a low pigment concentration is sucked from the second end 62*a* (second liquid sucking portion) positioned at the upper end. As a result, ink having a high pigment concentration sucked from the first end 61*a* and ink having a low pigment concentration sucked from the second end 62*a* are mixed in the joint member 50 of the communication channel RR, so that the pigment concentration is averaged. That is to say, the communication channel RR mixes ink in the liquid containing portion 45, and causes it to flow out to the liquid supply port 55, as ink whose pigment concentration is averaged.

Although not shown, even in a state where the consumption of ink in the liquid containing portion 45 progresses and the gap between the two film sheets 41 is narrowed, that is, the liquid bag 42 is flattened, the first end 61*a* is kept at the lower end position in the liquid containing portion 45, that is, in a state of being in contact with the film sheet 41 on the gravity direction (+Z) side. Furthermore, the second end 62*a* is kept at the upper end position in the liquid containing portion 45, that is, in a state of being in contact with the film sheet 41 on the anti-gravity direction (−Z) side.

According to the above-described embodiment, the following effects can be obtained.

(1) Ink having a comparatively high pigment concentration is sucked from the first end 61*a*, and ink having a comparatively low pigment concentration is sucked from the second end 62*a*, which are then mixed and caused to flow through the liquid supply port 55, and thus ink having a uniform pigment concentration can be supplied to the liquid ejection head 13. Accordingly, for example, in the case of printing an image on the paper P using ink ejected from the liquid ejection head 13, ink having a uniform pigment concentration is ejected, and thus a deterioration in the printing quality can be suppressed.

(2) Ink can be sucked from both the upper end and the lower end in the liquid containing portion 45 and mixed to be supplied to the liquid ejection head 13, and thus, even when the consumption of ink progresses, ink having a uniform concentration can be easily supplied to the liquid ejection head 13.

(3) The first end 61*a* functioning as the first liquid sucking portion and the second end 62*a* functioning as the second liquid sucking portion are respectively an end of the first channel R1 and an end of the second channel R2 constituting the communication channel RR, and thus the first liquid sucking portion and the second liquid sucking portion can be easily positioned in the liquid containing portion 45. Furthermore, the first liquid sucking portion and the second liquid sucking portion are tube ends (the first end 61*a* and the second end 62*a*) formed by cutting the first tube 61 and the second tube 62, and thus these liquid sucking portions can be easily produced in the liquid containing portion 45.

Note that the foregoing embodiment may be modified into the following other embodiments.

In the foregoing embodiment, a positioning unit that positions the first end 61*a* of the first channel R1 and the second end 62*a* of the second channel R2 without positional shift in the liquid containing portion 45 may be provided. Hereinafter, this modified example will be described with reference to the drawings.

Figure 5:
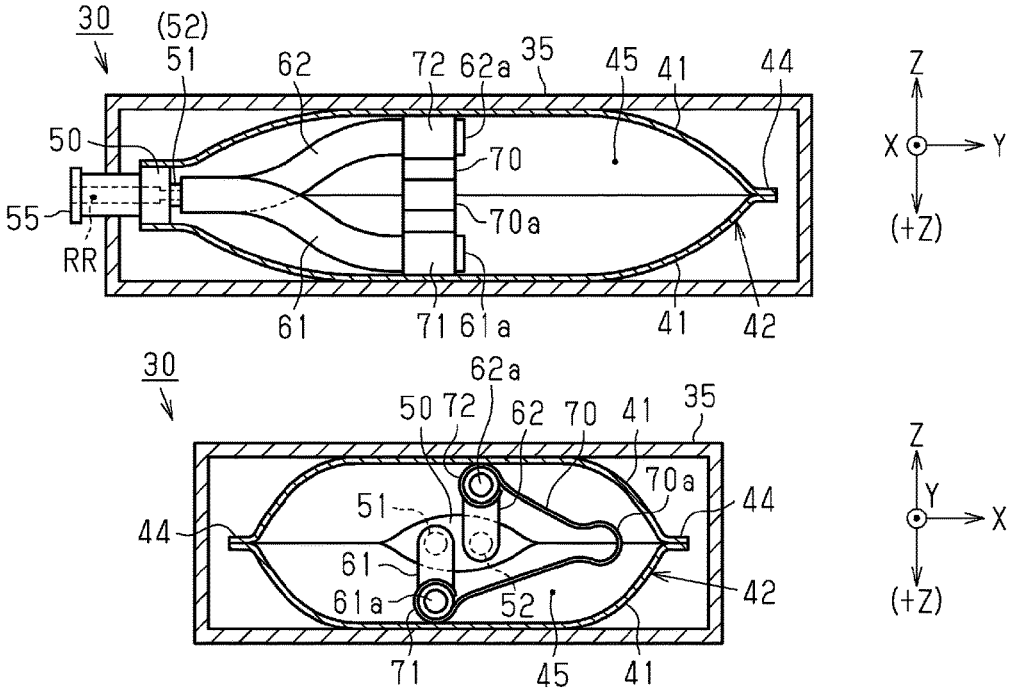
FIG. 5 shows cross-sectional views showing an example of the configuration of a positioning unit for liquid sucking portions in the liquid containing portion.
Figure 6:
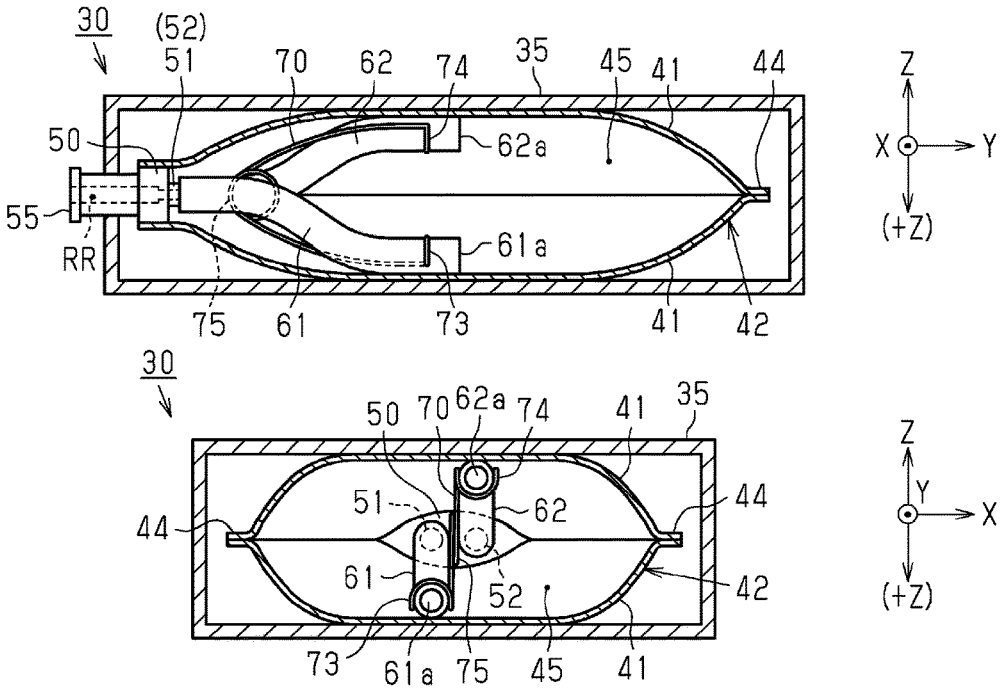
FIG. 6 shows cross-sectional views showing an example of the configuration of the positioning unit for the liquid sucking portions in the liquid containing portion.
Figure 7:
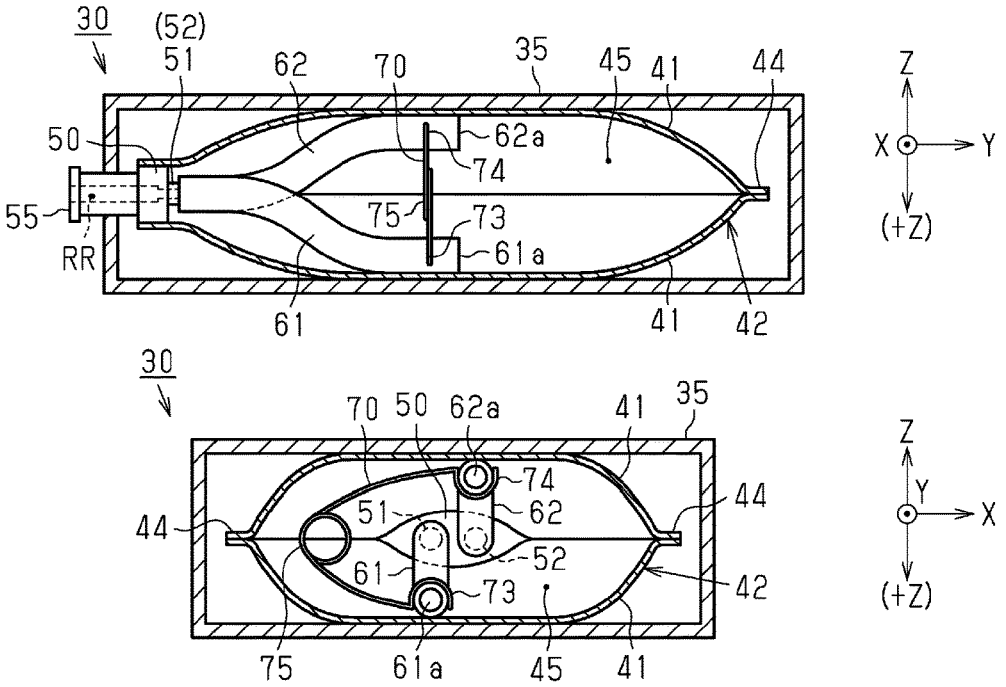
FIG. 7 shows cross-sectional views showing an example of the configuration of the positioning unit for the liquid sucking portions in the liquid containing portion.

As shown in FIGS. 5, 6, and 7, as a positioning unit, a biasing member 70 may be provided that is connected between the first end 61*a* and the second end 62*a*, and that biases the first end 61*a* toward the gravity direction (+Z) side and biases the second end 62*a* toward the anti-gravity direction (−Z) side. FIGS. 5, 6, and 7 show views corresponding to FIG. 4 in the foregoing embodiment.

First, as shown in FIG. 5, as the biasing member 70, a plate spring may be used that is an elastic band-like thin plate having a shape of being folded in two at a curved portion 70*a* provided substantially at the middle of the belt.

In the biasing member 70, one end side of the belt is provided with a first tubular portion 71 substantially in the shape of a circular tube, and the other end side of the belt is provided with a second tubular portion 72 substantially in the shape of a circular tube. A tube portion near the first end 61*a* of the first tube 61 constituting the first channel R1 is inserted into the first tubular portion 71, and a tube portion near the second end 62*a* of the second tube 62 constituting the second channel R2 is inserted into the second tubular portion 72. In other words, the biasing member 70 is connected at the first tubular portion 71 and the second tubular portion 72 between the first end 61*a* and the second end 62*a*.

The first end 61*a* and the second end 62*a* are biased away from each other, by a biasing force of the biasing member 70 generated by the first tubular portion 71 and the second tubular portion 72 moving closer to each other when the liquid bag 42 is flattened and the gap between the first end 61*a* and the second end 62*a* is narrowed in the vertical direction Z. As a result, the first end 61*a* is positioned and held at the lower end on the gravity direction (+Z) side in the liquid bag 42, and the second end 62*a* is positioned and held at the upper end on the anti-gravity direction (−Z) side in the liquid bag 42.

Alternatively, as shown in FIG. 6, as the biasing member 70, a torsion spring may be used that is made of an elastic wire material having a shape in which a wound portion 75 that is helically wound is provided at the middle.

In the biasing member 70 constituted by this torsion spring, one end side of the wire is provided with a first support portion 73 substantially in the shape of a semi-circle that supports a tube portion near the first end 61*a* of the first tube 61 from the anti-gravity direction (−Z) side. Furthermore, the other end side of the wire is provided with a second support portion 74 substantially in the shape of a semi-circle that supports a tube portion near the second end 62*a* of the second tube 62 from the gravity direction (+Z) side. That is to say, the biasing member 70 is connected at the first support portion 73 and the second support portion 74 between the first end 61*a* and the second end 62*a*. Furthermore, the biasing member 70 is included in the liquid containing portion 45 such that the wound portion 75 has a winding axis along the scanning direction X, and is positioned between the first tube 61 and the second tube 62 in the scanning direction X.

The first end 61*a* and the second end 62*a* are biased away from each other, by a biasing force of the biasing member 70 generated by the first support portion 73 and the second support portion 74 respectively supporting the first tube 61 and the second tube 62 moving closer to each other when the liquid bag 42 is flattened and the gap between the first end 61*a* and the second end 62*a* is narrowed in the vertical direction Z. As a result, the first end 61*a* is positioned and held at the lower end on the gravity direction (+Z) side in the liquid bag 42, and the second end 62*a* is positioned and held at the upper end on the anti-gravity direction (−Z) side in the liquid bag 42.

Alternatively, as shown in FIG. 7, in the case of using a torsion spring made of a wire material as the biasing member 70, the biasing member 70 may be included in the liquid containing portion 45 such that the wound portion 75 that is helically wound has a winding axis along the conveyance direction Y, and is positioned away from the first tube 61 and the second tube 62 in the scanning direction X.

As in the biasing member 70 shown in FIG. 6, the first support portion 73 supports a tube portion near the first end 61*a* of the first tube 61 constituting the first channel R1 and biases it in the gravity direction (+Z), and the second support portion 74 supports a tube portion near the second end 62*a* of the second tube 62 constituting the second channel R2 and biases it in the anti-gravity direction (−Z). Accordingly, the first end 61*a* and the second end 62*a* are biased away from each other by the biasing member 70, the first end 61*a* is positioned and held at the lower end on the gravity direction (+Z) side in the liquid bag 42, and the second end 62*a* is positioned and held at the upper end on the anti-gravity direction (−Z) side in the liquid bag 42.

According to the modified examples in FIGS. 5 to 7, the following effects can be obtained in addition to the effects (1) to (3) in the foregoing embodiment.

(4) The first end 61*a* and the second end 62*a* are positioned and held in the liquid containing portion 45, and thus positional shift of the first liquid sucking portion and the second liquid sucking portion is suppressed.

(5) With the biasing member 70 that is a positioning unit having a simple structure, the first end 61*a* that is the first liquid sucking portion and the second end 62*a* that is the second liquid sucking portion can be positioned in the liquid containing portion 45.

Figure 8:
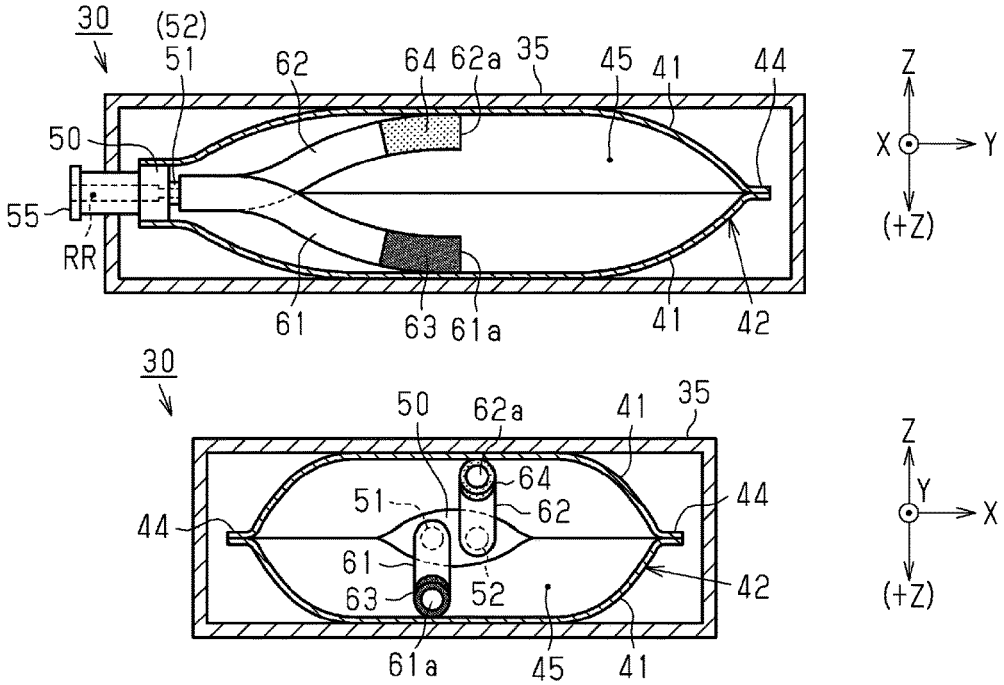
FIG. 8 shows cross-sectional views showing an example of the configuration of positioning units for the liquid sucking portions in the liquid containing portion.

Alternatively, as shown in FIG. 8, in the first channel R1 and the second channel R2, channel portions are made of materials respectively having different specific gravities with respect to ink, and the formed channel portions having different specific gravities may be provided as positioning units respectively for the first end 61*a* and the second end 62*a*. FIG. 8 shows views corresponding to FIG. 4 in the foregoing embodiment.

In this modified example, in the first tube 61 constituting the first channel R1, at least a tube portion 63 having a predetermined length from the first end 61*a* is made of a heavy material having a specific gravity that is larger than the specific gravity of the ink, as indicated by the dark shaded region in FIG. 8. On the other hand, in the second tube 62 constituting the second channel R2, at least a tube portion 64 having a predetermined length from the second end 62*a* is made of a light material having a specific gravity that is smaller than the specific gravity of the ink, as indicated by the light shaded region in FIG. 8. Accordingly, the first end 61*a* and the second end 62*a* move so as to be respectively lowered and lifted away from each other in the ink liquid by the channel portions made of materials respectively having different specific gravities. As a result, the first end 61*a* is positioned and held at the lower end on the gravity direction (+Z) side in the liquid bag 42 (in the ink liquid), and the second end 62*a* is positioned and held at the upper end on the anti-gravity direction (−Z) side in the liquid bag 42.

According to the modified example shown in FIG. 8, the following effect can be obtained in addition to the effects (1) to (3) in the foregoing embodiment and the effect (4) in the foregoing modified example.

(6) With a simple structure, the first end 61*a* and the second end 62*a* can be positioned in the liquid containing portion 45. Furthermore, in the case where the first channel R1 and the second channel R2 are made of materials having different specific gravities, the positioning units can be easily produced without increasing the number of parts.

Figure 9:
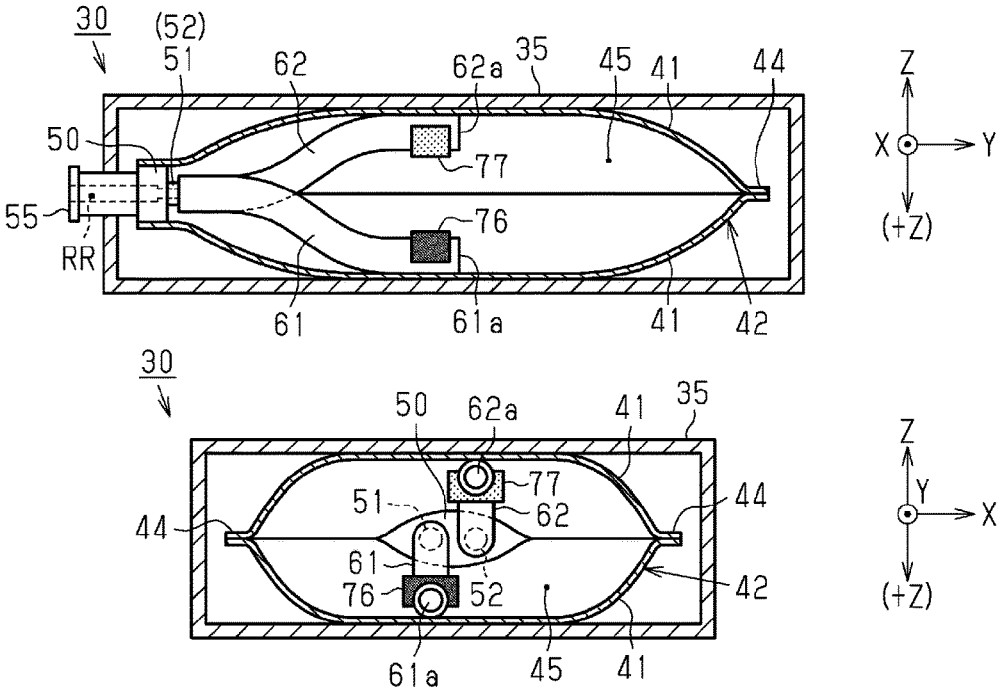
FIG. 9 shows cross-sectional views showing an example of the configuration of positioning units for the liquid sucking portions in the liquid containing portion.

Alternatively, as shown in FIG. 9, a weight member 76 attached to the first channel R1 and a float member 77 attached to the second channel R2 may be provided as positioning units. FIG. 9 shows views corresponding to FIG. 4 in the foregoing embodiment.

In this modified example, in the first tube 61 constituting the first channel R1, the weight member 76 made of a heavy material having a specific gravity that is larger than the specific gravity of the ink is attached in a contact state at least to the anti-gravity direction (−Z) side of a tube portion near the first end 61*a,* as indicated by the dark shaded region in FIG. 9. Furthermore, in the second tube 62 constituting the second channel R2, the float member 77 made of a light material having a specific gravity that is smaller than the specific gravity of the ink is attached in a contact state at least to the gravity direction (+Z) side of a tube portion near the second end 62*a,* as indicated by the light shaded region in FIG. 9. In other words, the weight member 76 is attached to the first channel R1, and the float member 77 is attached to the second channel R2. Accordingly, the first end 61*a* and the second end 62*a* move so as to be respectively lowered and lifted away from each other in the ink liquid by the weight member 76 and the float member 77 made of materials respectively having different specific gravities. As a result, the first end 61*a* is positioned and held at the lower end on the gravity direction (+Z) side in the liquid bag 42, and the second end 62*a* is positioned and held at the upper end on the anti-gravity direction (−Z) side in the liquid bag 42.

According to the modified example shown in FIG. 9, the following effect can be obtained in addition to the effects (1) to (3) in the foregoing embodiment and the effect (4) in the foregoing modified example.

(7) With a simple structure, the first end 61*a* and the second end 62*a* can be positioned in the liquid containing portion 45.

In the foregoing embodiment, positioning units that position the first end 61*a* of the first channel R1 and the second end 62*a* of the second channel R2 in the liquid containing portion 45 without biasing the ends may be provided. This modified example will be described with reference to the drawings.

Figure 10:
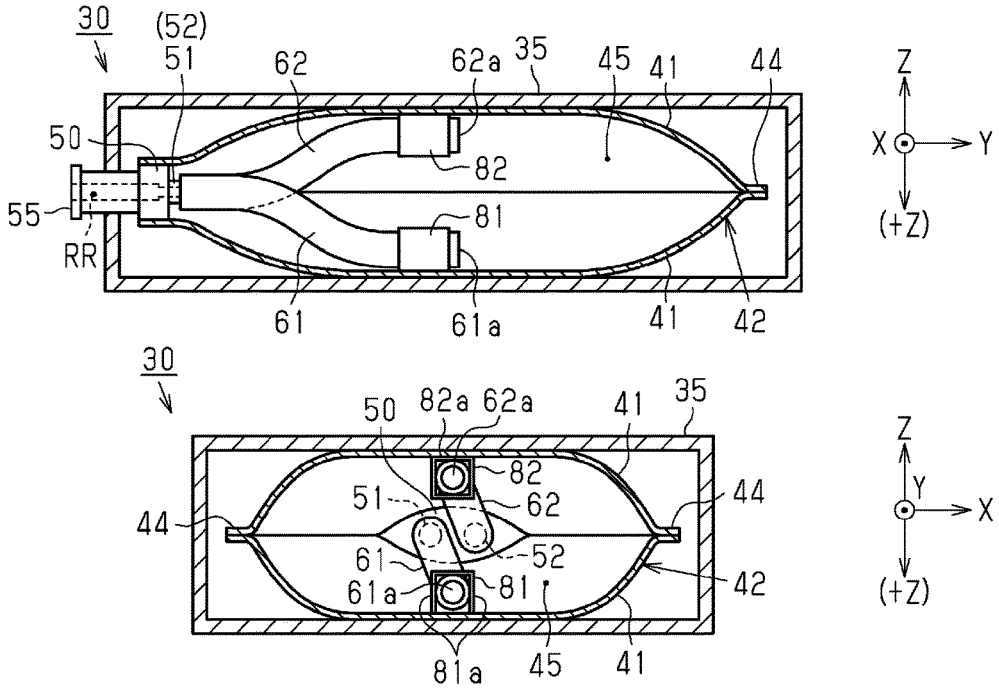
FIG. 10 shows cross-sectional views showing the configuration of the liquid containing portion including block members for positioning the liquid sucking portions.

As shown in FIG. 10, as the positioning units, block members respectively attached to the first end 61*a* and the second end 62*a* and fixed to the film sheets 41 may be provided. FIG. 10 shows views corresponding to FIG. 4 in the foregoing embodiment.

In this modified example, as a block member, a first block member 81 substantially in the shape of a U constituted by three tube walls in which one of the tube walls of an angular tube is open is fixed to the film sheet 41 on the gravity direction (+Z) side in a state where a tube portion near the first end 61*a* of the first tube 61 is held in the U shape. That is to say, the first block member 81 is attached to the first end 61*a* and fixed to the film sheet 41, so that the first end 61*a* is positioned in the liquid containing portion 45. Furthermore, as another block member, a second block member 82 in the shape of an angular tube constituted by four tube walls is fixed to the film sheet 41 on the anti-gravity direction (−Z) side in a state where a tube portion near the second end 62*a* of the second tube 62 is held in the angular tube. That is to say, the second block member 82 is attached to the second end 62*a* and fixed to the film sheet 41, so that the second end 62*a* is positioned in the liquid containing portion 45.

Note that, in this modified example, both of the first block member 81 and the second block member 82 may be substantially in the shape of a U in which one of the tube walls of an angular tube is open, or may be in the shape of an angular tube constituted by four tube walls. Furthermore, both of the first block member 81 and the second block member 82 do not necessarily have to be in the shape of an angular tube, and may be in the shape of a polygonal tube or a circular tube.

In this modified example, the first block member 81 is made of the same material as the film sheets 41, and is fixed to the corresponding film sheet 41 such that two tube walls 81*a* positioned on both sides in the scanning direction X of the first tube 61 and having an opening interposed therebetween are adhered, at portions thereof in contact with the film sheet 41, to the film sheet 41. Furthermore, the second block member 82 is made of the same material as the film sheets 41, and is fixed to the corresponding film sheet 41 such that one tube wall 82*a* constituting the angular tube is adhered, at a portion thereof in contact with the film sheet 41, to the film sheet 41. Accordingly, the first end 61*a* and the second end 62*a* are respectively positioned by the first block member 81 and the second block member 82, so that the first end 61*a* is positioned and held at the lower end on the gravity direction (+Z) side in the liquid bag 42, and the second end 62*a* is positioned and held at the upper end on the anti-gravity direction (−Z) side in the liquid bag 42. It will be appreciated that the first block member 81 or the second block member 82 may be made of a material different from that of the film sheets 41, and the block members may be fixed to the film sheets 41 by adhesion or bonding regardless of the material forming the block members.

Note that, in this modified example, the first block member 81 can fix the position of the first end 61*a* in the scanning direction X in the liquid bag 42, and the second block member 82 can fix the position of the second end 62*a* in the scanning direction X in the liquid bag 42.

According to the modified example shown in FIG. 10, the following effect can be obtained in addition to the effects (1) to (3) in the foregoing embodiment and the effect (4) in the foregoing modified example.

(8) With a simple structure, the first end 61*a* and the second end 62*a* can be precisely positioned in the liquid containing portion 45. As a result, for example, if the first end 61*a* is precisely positioned at the lowest position in the liquid containing portion 45, the amount of ink remaining in the liquid containing portion 45 can be made as small as possible.

The positioning units of the modified example shown in FIG. 10 may be additionally used in the modified examples shown in FIGS. 5 to 9. That is to say, block members (the first block member 81 and the second block member 82) that are respectively attached to the first channel R1 and the second channel R2 and adhered to the film sheets 41 so as to position the first end 61*a* and the second end 62*a* in the liquid containing portion 45 may be provided so as to be included in the positioning units shown in FIGS. 5 to 9.

In the foregoing embodiment, a member that supports the first channel R1 and the second channel R2 in the liquid containing portion 45 may be provided as a positioning unit for the first end 61*a* and the second end 62*a*. This modified example will be described with reference to the drawings.

Figure 11:
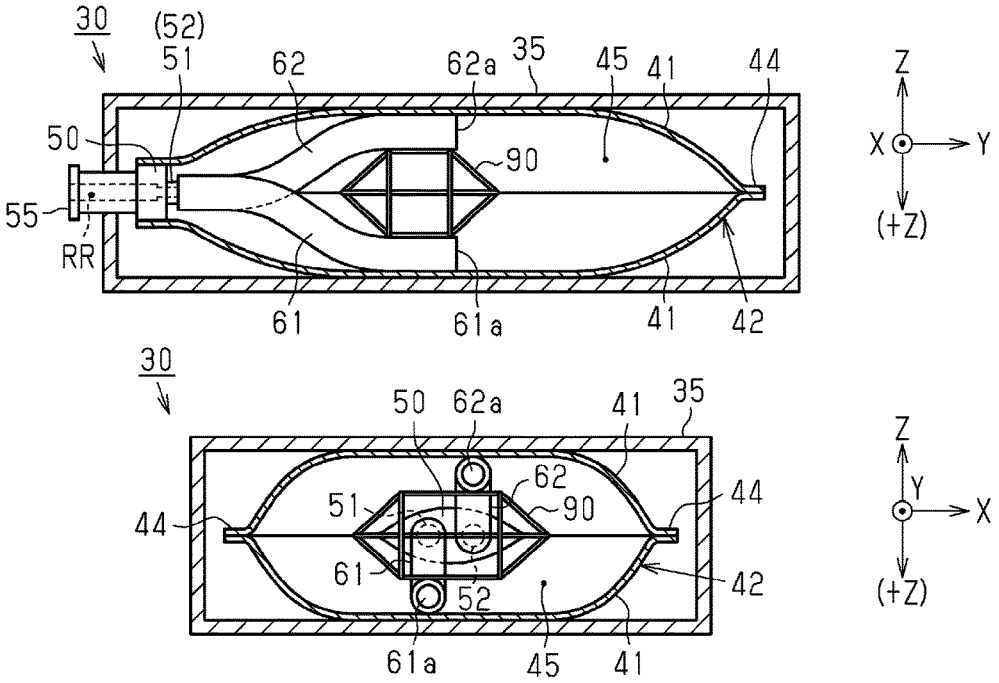
FIG. 11 shows cross-sectional views showing the configuration of the liquid containing portion including a frame member for positioning the liquid sucking portions.

As shown in FIG. 11, a frame member 90, which is an example of a member that is inserted between the first tube 61 and the second tube 62 in the vertical direction Z and supports the first tube 61 (the first channel R1) and the second tube 62 (the second channel R2) in the liquid containing portion 45, may be provided as a positioning unit. FIG. 11 shows views corresponding to FIG. 4 in the foregoing embodiment.

In this modified example, the frame member 90 is in the shape of a basket formed by combining a plurality of thin wires, wherein the first tube 61 is supported on the lower side that is the gravity direction (+Z) side of the basket, and the second tube 62 is supported on the upper side that is the anti-gravity direction (−Z) side of the basket. Accordingly, the first end 61*a* of the first tube 61 is positioned and held by the frame member 90 at the lower end on the gravity direction (+Z) side in the liquid bag 42, and the second end 62*a* of the second tube 62 is positioned and held by the same at the upper end on the anti-gravity direction (−Z) side in the liquid bag 42.

Although not shown, the frame member 90 can be deformed such that the basket-like shape is squeezed in the vertical direction Z, and the basket-like shape is deformed so as to be gradually squeezed in accordance with deformation of the liquid bag 42 due to consumption of ink in the liquid containing portion 45. At that time, the frame member 90 is deformed while continuously positioning the first end 61*a* and the second end 62*a* in the liquid bag 42 (in the liquid containing portion 45), in accordance with squeezing of the basket-like shape.

According to the modified example shown in FIG. 11, the following effect can be obtained in addition to the effects (1) to (3) in the foregoing embodiment and the effect (4) in the foregoing modified example.

(9) With a simple structure, the first end 61*a* and the second end 62*a* can be precisely positioned in the liquid containing portion 45.

The positioning unit of the modified example shown in FIG. 11 may be additionally used in the modified examples shown in FIGS. 5 to 9. That is to say, a frame member 90 that is inserted between the first tube 61 and the second tube 62 and supports the first tube 61 (the first end 61*a*) and the second tube 62 (the second end 62*a*) in the liquid containing portion 45 may be provided so as to be included in the positioning units shown in FIGS. 5 to 9.

In the foregoing embodiment, as an example of a support member that supports the first end 61*a* of the first channel R1 and the second end 62*a* of the second channel R2 in the liquid containing portion 45, a frame member 90 that is partially fixed to a member constituting the liquid containing portion 45 may be provided as a positioning unit. This modified example will be described with reference to the drawings.

Figure 12:
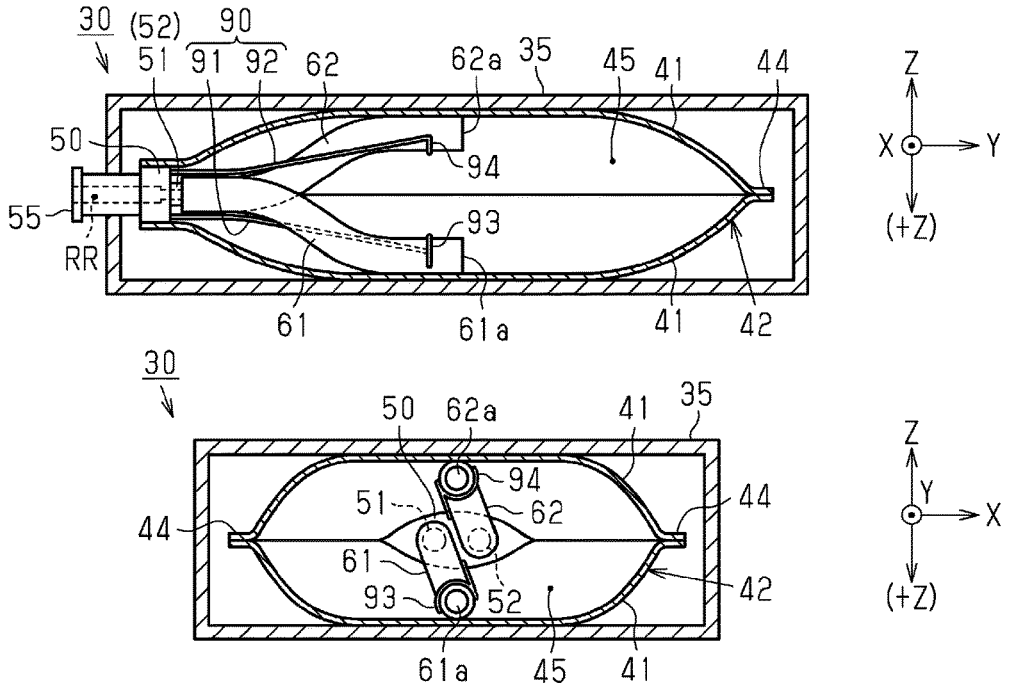
FIG. 12 shows cross-sectional views showing the configuration of the liquid containing portion to which the frame member for positioning the liquid sucking portions is fixed.

As shown in FIG. 12, in this modified example, a first wire member 91 having one end that is fixed to the joint member 50 constituting the liquid containing portion 45 and a second wire member 92 also having one end that is fixed to the joint member 50 constituting the liquid containing portion 45 are provided as the frame member 90. FIG. 12 shows views corresponding to FIG. 4 in the foregoing embodiment.

In the frame member 90 of this modified example, the first wire member 91 has the other end that is a first support portion 93 in the shape of a semi-circle that supports a tube portion near the first end 61*a* of the first tube 61 from the upper side and holds the tube portion at the lower end in the liquid bag 42 (in the liquid containing portion 45). Furthermore, the second wire member 92 has the other end that is a second support portion 94 in the shape of a semi-circle that supports a tube portion near the second end 62*a* of the second tube 62 from the lower side and holds the tube portion at the upper end in the liquid bag 42. Accordingly, movement of the first end 61*a* and the second end 62*a* in the scanning direction X or in the vertical direction Z is restricted in the liquid bag 42 by the frame member 90 having ends that are fixed to the joint member 50. In other words, rotation of the first end 61*a* and the second end 62*a* is restricted in plane that intersects the conveyance direction Y in the liquid containing portion 45.

The frame member 90 can be deformed such that the first wire member 91 and the second wire member 92 are warped in the vertical direction Z, and is deformed so as to be gradually warped in the vertical direction Z in accordance with flattening of the liquid bag 42 due to consumption of ink in the liquid containing portion 45. Accordingly, in the liquid bag 42 that is being gradually flattened, the first end 61*a* and the second end 62*a* move in the vertical direction Z, with its rotation in plane that intersects the conveyance direction Y restricted by the frame member 90.

Note that, in this modified example, the first wire member 91 and the second wire member 92 may be made of linear resin materials instead of metal, and respectively have ends that are fixed to the liquid bag 42 constituting the liquid containing portion 45.

According to the modified example shown in FIG. 12, the following effect can be obtained in addition to the effects (1) to (3) in the foregoing embodiment and the effect (4) in the foregoing modified example.

(10) The first end 61*a* and the second end 62*a* are prevented from rotating in the liquid containing portion 45, so that the first end 61*a* and the second end 62*a* can be reliably positioned in the liquid containing portion 45.

It will be appreciated that the positioning unit of the modified example shown in FIG. 12 may be additionally used in the modified examples shown in FIGS. 5 to 9. That is to say, a frame member 90 that is partially fixed to the liquid containing portion 45 may be provided so as to be included in the positioning units shown in FIGS. 5 to 9.

In the foregoing embodiment, the second end 62*a* as the second liquid sucking portion does not necessarily have to be positioned at the upper end on the anti-gravity direction (−Z) side in the liquid containing portion 45 in an in-use state, and may be positioned anywhere as long as it is positioned closer to the anti-gravity direction (−Z) side than the first end 61*a* as the first liquid sucking portion is. This modified example will be described with reference to the drawings.

Figure 13:
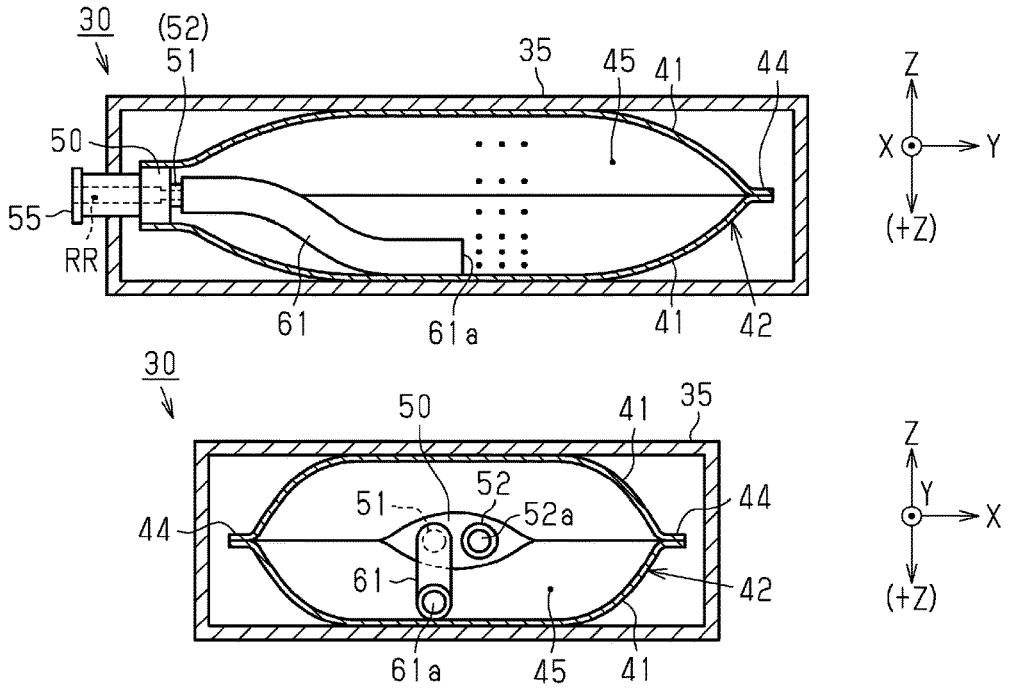
FIG. 13 shows cross-sectional views showing a modified example of the configuration of the liquid sucking portions in the liquid containing portion.

As shown in FIG. 13, in this modified example, the second tube 62 is removed from the second communication port 52 of the joint member 50, and an end 52*a* of the second communication port 52, which becomes an end of the second channel R2, is provided as the second liquid sucking portion. FIG. 13 shows views corresponding to FIG. 4 in the foregoing embodiment.

In this modified example, in an in-use state in which ink is supplied from the liquid supply port 55 to the liquid ejection head 13, the first end 61*a* of the first tube 61 is positioned at the lower end on the gravity direction (+Z) side in the liquid containing portion 45. Furthermore, the end 52*a* of the second communication port 52 is positioned closer to the anti-gravity direction (−Z) side than the first end 61*a* is, in the liquid containing portion 45.

Accordingly, as indicated by the black dots in part of the liquid containing portion 45 in FIG. 13, ink having a high pigment concentration is sucked from the first end 61*a* (first liquid sucking portion) positioned at the lower end, and ink having a lower pigment concentration is sucked from the second communication port 52 (second liquid sucking portion). As a result, ink having a high pigment concentration sucked from the first end 61*a* and ink having a low pigment concentration sucked from the second communication port 52 are mixed in the joint member 50, so that the pigment concentration is averaged.

In the foregoing embodiment, the communication channel RR does not necessarily have to have a configuration in which its channels join together in the joint member 50 provided with the first communication port 51 and the second communication port 52. This modified example will be described with reference to the drawings.

Figure 14:
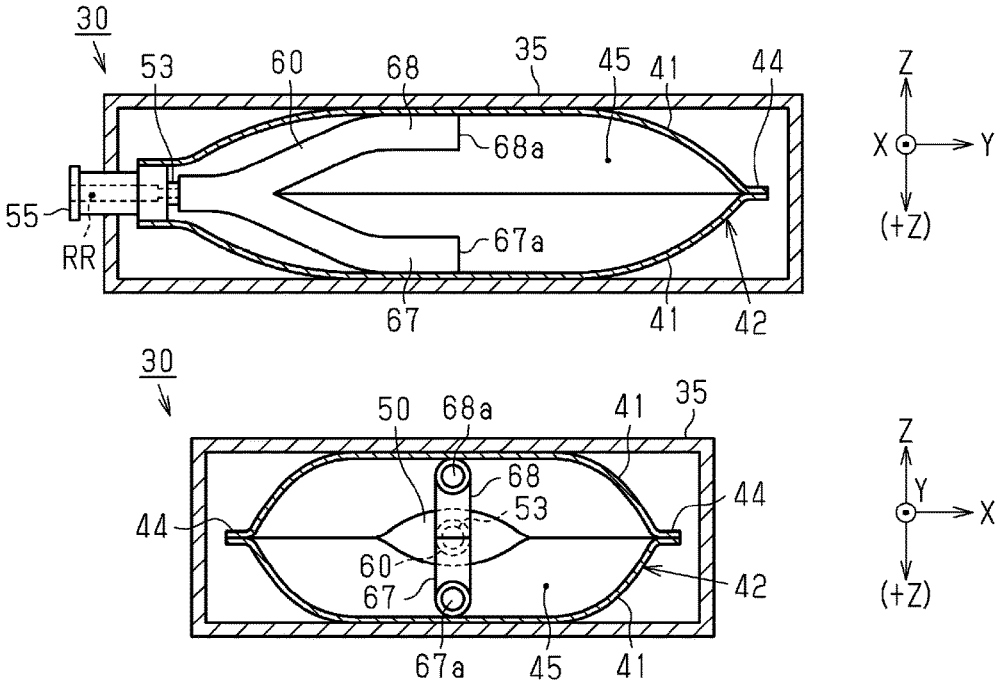
FIG. 14 shows cross-sectional views showing a modified example of the configuration of the liquid sucking portions in the liquid containing portion.

As shown in FIG. 14, in this modified example, the joint member 50 is provided with one communication port 53 that is in communication with the liquid supply port 55, and a branched tube 60 having a branched channel in which one channel is branched into two channels is attached to the one communication port 53. FIG. 14 shows views corresponding to FIG. 4 in the foregoing embodiment.

In this modified example, one channel side of the branched tube 60 is pushed into and attached to the communication port 53, wherein an end 67*a* of a branched first tube 67 having one branched channel of the branched two branched channels is positioned at the lower end on the gravity direction (+Z) side in the liquid containing portion 45 in an in-use state in which ink is supplied from the liquid supply port 55 to the liquid ejection head 13. Furthermore, an end 68*a* of a branched second tube 68 having the other branched channel of the branched two branched channels is positioned at the upper end on the anti-gravity direction (−Z) side in the liquid containing portion 45 in an in-use state in which ink is supplied from the liquid supply port 55 to the liquid ejection head 13.

Accordingly, in this modified example, as shown in FIG. 4 in the foregoing embodiment, ink having a high pigment concentration is sucked from the end 67*a* (first liquid sucking portion) of the branched first tube 67 positioned at the lower end, and ink having a low pigment concentration is sucked from the end 68*a* (second liquid sucking portion) of the branched second tube 68 positioned at the upper end. As a result, ink having a high pigment concentration sucked from the end 67*a* and ink having a low pigment concentration sucked from the end 68*a* are mixed in the branched tube 60, so that ink whose pigment concentration is averaged is discharged to the liquid supply port 55.

In the foregoing embodiment, at least a portion of the liquid containing portion 45 may not be made of film sheets. This modified example will be described with reference to the drawings.

Figure 15:
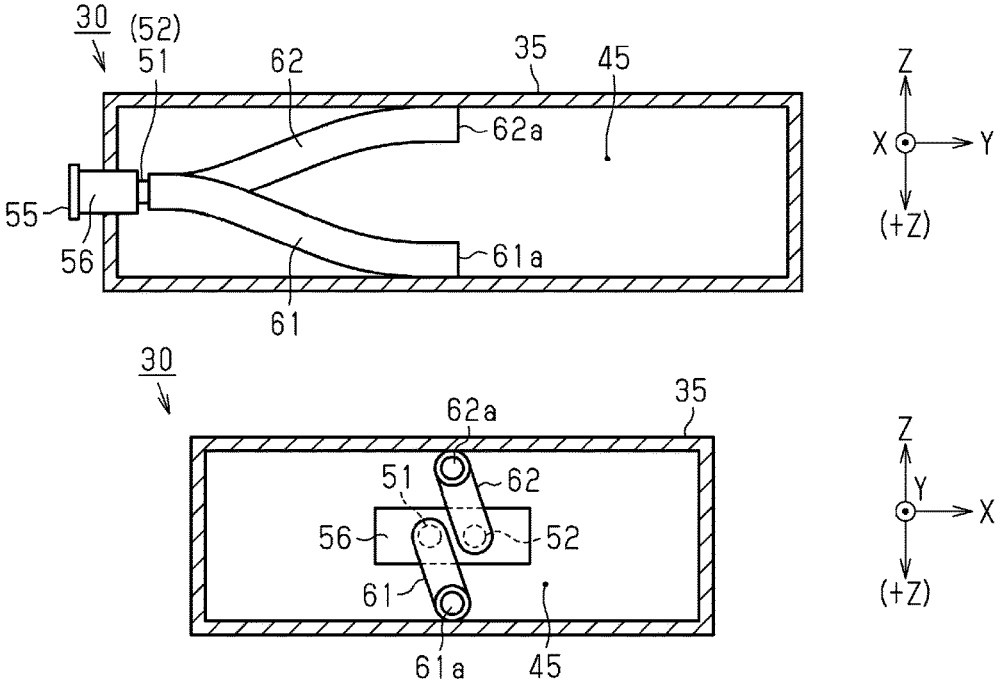
FIG. 15 shows cross-sectional views showing a modified example of the configuration of the liquid containing member having the liquid containing portion.

As shown in FIG. 15, in this modified example, the liquid containing member 30 is formed such that its interior functions as the liquid containing portion 45. That is to say, the liquid containing member 30 has the container casing 35 that can internally contain ink without leakage, and a supply port member 56 that is provided at part of the container casing 35 and is provided with the liquid supply port 55. In the supply port member 56, the first communication port 51 and the second communication port 52 that are in communication with the liquid supply port 55 are formed on the internal space side of the container casing 35, and, as in the foregoing embodiment, the first tube 61 and the second tube 62 are respectively attached to the first communication port 51 and the second communication port 52.

In an in-use state in which ink is supplied from the liquid supply port 55 to the liquid ejection head 13, the first end 61*a* of the first tube 61 is positioned at the lower end on the gravity direction (+Z) side in the liquid containing portion 45. Furthermore, the second end 62*a* of the second tube 62 is positioned closer to the anti-gravity direction (−Z) side (upper end, in this example) than the first end 61*a* of the first tube 61 is, in the liquid containing portion 45. In this modified example, for example, the second tube 62 is made of a light material having a specific gravity that is smaller than the specific gravity of the ink, and, in the internal space of the container casing 35 as the liquid containing portion 45, the second end 62*a* of the second tube 62 is positioned near the ink surface, and is lowered together with the ink surface that is lowered in accordance with consumption of ink.

With this configuration, in this modified example, as shown in FIG. 4 in the foregoing embodiment, ink having a high pigment concentration is sucked from the first end 61*a* (first liquid sucking portion) of the first tube 61 positioned at the lower end, and ink having a low pigment concentration is sucked from the second end 62*a* (second liquid sucking portion) of the second tube 62. As a result, ink having a high pigment concentration sucked from the first tube 61 and ink having a low pigment concentration sucked from the second tube 62 are mixed in an unshown channel in the supply port member 56, so that ink whose pigment concentration is averaged is discharged to the liquid supply port 55.

In the liquid containing member 30 of this modified example, It is preferable that the first tube 61 and the second tube 62 are arranged such that the first end 61*a* and the second end 62*a* that function as liquid sucking portions are positioned at the center of the liquid containing portion 45 in the scanning direction X, as shown in FIG. 15. Thus, the biasing member 70 of the modified examples shown in FIGS. 5 to 7, the first tube 61 and the second tube 62 having channel portions having different specific gravities shown in FIG. 8, the weight member 76 and the float member 77 shown in FIG. 9, the block members shown in FIG. 10, and the frame member 90 shown in FIGS. 11 and 12 may be provided in the liquid containing member 30 of this modified example.

In the foregoing embodiment, the first liquid sucking portion does not necessarily have to be the first end 61*a* that is in communication with the liquid containing portion 45 in the first channel R1. Alternatively, the second liquid sucking portion does not necessarily have to be the second end 62*a* that is in communication with the liquid containing portion 45 in the second channel R2. Although not shown, for example, the first liquid sucking portion may not be a tube end of the first tube 61 but may be one or a plurality of holes provided partway along the tube. Furthermore, the second liquid sucking portion may not be a tube end of the second tube 62 but may be one or a plurality of holes provided partway along the tube.

In the foregoing embodiment, the liquid containing member 30 may be provided outside the casing 12 of the liquid consuming apparatus 11. In the case where ink is supplied from the liquid containing member 30 provided outside the casing 12 to the liquid ejection head 13 inside the casing 12, for example, the liquid supply tubes 19 for supplying the ink may be arranged from the outside of the casing 12 via a gap provided at the casing 12 into the inside of the casing 12.

In the foregoing embodiment, the medium is not limited to the paper P, and the medium may be a plastic film, a thin plate material, or the like, or may be a fabric used in a textile printing device and the like.

In the foregoing embodiment, the liquid consuming apparatus 11 may not be provided with the carriage 16, and may be changed to a so-called full-line apparatus (printer) including a fixed long liquid ejection head 13 corresponding to the fill width of the paper P. The liquid ejection head 13 in this case may be a plurality of unit heads that are arranged side by side such that the recording range covers the full width of the paper P, or may be a single long head that is disposed so as to extend across the full width of the paper P such that the recording range covers the full width of the paper P.

In the foregoing embodiment, the liquid consuming apparatus 11 may be an apparatus that ejects or discharges a liquid other than ink. Note that the states of the liquid discharged as very small droplets from the liquid consuming apparatus include a granular shape, a tear-drop shape, and a shape having a thread-like trailing end. Furthermore, the liquid mentioned here may be any kind of material that can be ejected from the liquid consuming apparatus. For example, the liquid may be any material that is in a liquid phase, and examples thereof include fluids such as an inorganic solvent, an organic solvent, a solution, a liquid resin, and a liquid metal (metal melt) in the form of a liquid body having a high or low viscosity, a sol, gel water, or the like. Furthermore, the examples include not only liquid, as one state of materials, but also materials in which solvent contains dissolved, dispersed, or mixed particles (precipitating component) of a functional material made of a solid, such as pigments or metal particles. Representative examples of the liquid include ink such as that described in the foregoing embodiment, liquid crystal, or the like. Here, "ink" encompasses general water-based ink and oil-based ink, as well as various types of liquid compositions such as gel ink and hot melt-ink. Specific examples of the liquid consuming apparatus include an apparatus that ejects a liquid containing a material (precipitating component), such as an electrode material or a color material used for manufacturing a liquid crystal display, an EL (electro-luminescence) display, a surface emission display, or a color filter, for example, in the form of being dispersed or dissolved. The liquid consuming apparatus may also be an apparatus that ejects biological organic matter used in manufacturing of a biochip, an apparatus that is used as a precision pipette and ejects a liquid serving as a sample, a textile printing apparatus, a microdispenser, or the like.

What is claimed is:

1. A liquid containing member capable of supplying a liquid having a precipitating component to a liquid ejecting portion, comprising:

a liquid containing portion configured to contain the liquid;

a liquid supply port configured to supplying the liquid contained in the liquid containing portion to the liquid ejecting portion; and a communication channel communicating with the liquid containing portion and the liquid supply port, the communication channel includes:

a joint member including the liquid supply port, a first communication port communicating with the liquid supply port, and a second communication port communicating with the liquid supply port, a first tube attached to the first communication port, a second tube attached to the second communication port, a first liquid sucking portion positioned at a lower side relative to the liquid supply port on the gravity direction side in the liquid containing portion, the first liquid sucking portion is an end of a first channel, the first channel is configured so that the liquid sucked from the first liquid sucking portion flows to the liquid supply port via the first tube and the first communication port, in an in-use state in which the liquid is supplied from the liquid supply port to the liquid ejecting portion, and a second liquid sucking portion positioned at the anti-gravity direction side relative to the first liquid sucking portion, the second liquid sucking portion is an end of a second channel, the second channel is configured so that the liquid sucked from the second liquid sucking portion is flows to the liquid supply port via the second tube and the second communication port, in the in-use state.

2. The liquid containing member according to claim 1, wherein, in the in-use state, the second liquid sucking portion is positioned at an upper end on the anti-gravity direction side in the liquid containing portion.

3. The liquid containing member according to claim 1, further comprising a positioning unit that positions the end of the first channel and the end of the second channel in the liquid containing portion.

4. The liquid containing member according to claim 3, wherein the positioning unit is a biasing member that is connected between the end of the first channel and the end of the second channel, and that biases the end of the first channel toward the gravity direction side and biases the end of the second channel toward the anti-gravity direction side.

5. The liquid containing member according to claim 3, wherein the positioning unit is channel portions made of materials respectively having different specific gravities with respect to the liquid, in the first channel and the second channel.

6. The liquid containing member according to claim 3, wherein the positioning unit is a weight member that is attached to the first channel and a float member that is attached to the second channel.

7. The liquid containing member according to claim 3, wherein the liquid containing portion is at least partially made of a film sheet, and the positioning unit includes a block member that is attached to the first end and the second end and is fixed to the film sheet.

8. The liquid containing member according to claim 3, wherein the positioning unit includes a frame member that supports the first channel and the second channel in the liquid containing portion.

9. The liquid containing member according to claim 8, wherein the frame member is partially fixed to a member constituting the liquid containing portion.

* * * * *